United States Patent [19]

Coussan

[11] 4,040,481

[45] Aug. 9, 1977

[54] ARRANGEMENT FOR POSITIONING A MEMBER IN A RECEIVING SECTION OF A SIDE POCKET MANDREL

[75] Inventor: Sidney G. Coussan, Lafayette, La.

[73] Assignee: Production Specialties, Inc., Lafayette, La.

[21] Appl. No.: 686,907

[22] Filed: May 17, 1976

[51] Int. Cl.[2] ..... E21B 23/00

[52] U.S. Cl. ..... 166/214

[58] Field of Search ..... 166/136, 214; 294/86.24, 86.25

[56] References Cited

U.S. PATENT DOCUMENTS

| | | | |
|---|---|---|---|
| 2,392,244 | 1/1946 | Hooser | 166/136 |
| 2,664,162 | 12/1953 | Howard et al. | 166/65 M |
| 2,856,007 | 10/1958 | Fredd | 166/214 |
| 3,005,494 | 10/1961 | Daffin | 166/136 |
| 3,074,485 | 1/1963 | McGowen, Jr. | 166/217 |
| 3,827,490 | 8/1974 | Moore, Jr. et al. | 166/117.5 |

*Primary Examiner*—James A. Leppink
*Attorney, Agent, or Firm*—Jack W. Hayden

[57] ABSTRACT

A releasable, retrievable latch includes a mandrel having one end threaded externally and an internally threaded socket formed on the other end thereof. A body has one end with a configuration for engagement with a running tool and the other end of the body is provided with a longitudinal bore therein, the innermost end of which is threaded whereby the body may be threadedly engaged with the external threaded end of the mandrel. The bore adjacent the other end of the mandrel has a plurality of longitudinally extending circumferentially spaced slots to form a plurality of flexible longitudinally extending portions so that such portions will flex when engaged with an enlargement as the latch is moved into seated position in a receiving section of a side pocket mandrel. The threaded socket on the end of the mandrel engages with a member which is to be positioned in the receiving section of the side pocket mandrel.

5 Claims, 3 Drawing Figures

ARRANGEMENT FOR POSITIONING A MEMBER IN A RECEIVING SECTION OF A SIDE POCKET MANDREL

SUMMARY OF THE INVENTION

Various devices have been provided and are illustrated in the prior art for latching members, such as well tools and other devices in a tubular string and more particularly in the receiving section of a side pocket mandrel such as shown in U.S. Pat. Nos. 2,664,162; 3,827,490; and 3,074,485.

Some of the disadvantages with prior art devices of the type to which the present invention relates is that they are constructed and arranged so that certain components thereof, such as a shear pin, needs replacement after each use of the device. Some of such devices employ a nonflexible annular member forming an enlargement which is adapted to cooperate with an enlargement in the receiving section of a side pocket mandrel so as to latch or position the member secured with the latch in position in the receiving section of the mandrel. The rigidity of the annular member and its engagement with the enlargement in the mandrel causes wear thereof so that such annular member must be replaced after a period of use.

The present invention is directed to a latch which may be used with a running tool to position a member in a receiving section of a side pocket mandrel and which is constructed and arranged to eliminate wear thereon to enable it to be employed repeatedly and thereby minimize replacement or repair of components.

Yet another object of the present invention is to provide a relatively simple latch arrangement incorporating a minimum number of parts which cooperate to secure a member in a receiving section of a side pocket mandrel and which may be actuated to retrieve the member from the mandrel.

Yet a further object of the present invention is to provide a latch for use with a running tool to position a member in a receiving section of a side pocket mandrel which invention incorporates a body which is threaded at one end and is provided with an internally threaded socket at the other end whereby a member to be positioned in the side pocket mandrel may be engaged in the socket. A sleeve is provided with a bore extending longitudinally thereof the innermost end of which is threaded for threaded engagement with the threaded end of the body so that the body and sleeve may be secured together. One end of the sleeve is provided with a configuration to enable it to be engaged releasably with a running tool and the other end of the sleeve is provided with a plurality of circumferentially spaced longitudinally extending slots to provide a plurality of flexible longitudinally extending portions which have an annular extending enlargement thereon to cooperate with a receiving section of the side pocket mandrel for positioning a member therein and releasably latching it in position in such side pocket mandrel.

Yet a further object of the present invention is to provide a latch for use with a running tool to position a member in a receiving section of a side pocket mandrel which invention incorporates a body which is threaded at one end and is provided with an internally threaded socket at the other end whereby a member to be positioned in the side pocket mandrel may be engaged in the socket. A sleeve is provided with a bore extending longitudinally thereof the innermost end of which is threaded for threaded engagement with the threaded end of the body so that the body and sleeve may be secured together. One end of the sleeve is provided with a configuration to enable it to be engaged releasably with a running tool and the other end of the sleeve is provided with a plurality of circumferentially spaced longitudinally extending slots to provide a plurality of flexible longitudinally extending portions which have an annular extending enlargement thereon to cooperate with a receiving section of the side pocket mandrel for positioning a member therein and releasably latching it in position in such side pocket mandrel. The running tool is constructed and arranged so that when it fits over the end of the sleeve, longitudinal blows may be delivered to the sleeve to drive or position the latch and member engaged therewith in position in the receiving section of the side pocket mandrel, and means releasably engage the running tool with the end of the sleeve which are constructed and arranged so as to disengage the running tool from the sleeve when a predetermined downward jarring effort is applied to the well string. The running tool may then be retrieved from the well bore leaving the latch and attached device in position in the mandrel.

Other objects and advantages of the present invention will become apparent from a consideration of the following drawings and description.

BRIEF DESCRIPTION OF THE PREFERRED EMBODIMENT

Figure 1:
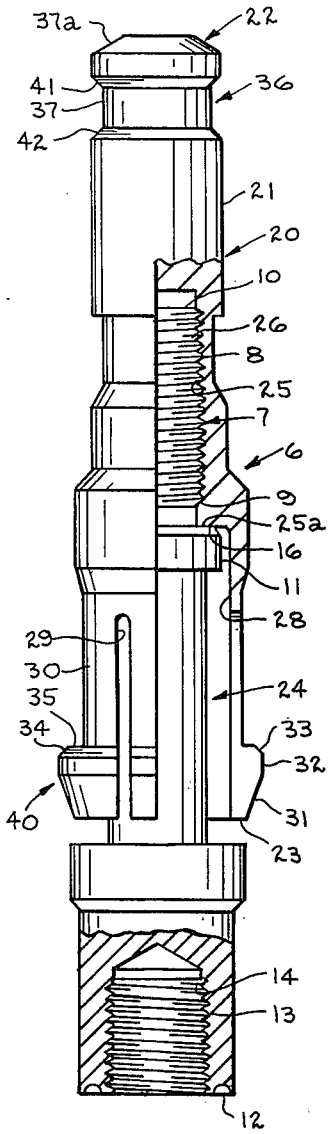
FIG. 1 is a partial sectional, partial elevational longitudinal view of the preferred form of he latch employed with the present invention.

Attention is directed to FIG. 1 of the drawings wherein the latch forming part of the present invention is referred to generally by the numeral 6. It will be noted that it includes two parts, a body referred to generally at 7 and a sleeve referred to generally at 20.

The body 7 extends longitudinally and is provided with threads 8 extending longitudinally thereof from any suitable position such as the position 9 to the end 10 of the body 7.

A shoulder 11 which projects annularly from the body 7 is provided intermediate the ends 10 and 12, the end 12 comprising the other end of the body 7. It will be noted that a socket 13 is provided in the other end 12 which is threaded internally as illustrated at 14. When the body 7 and sleeve 20 are secured together they assume the relationship illustrated in FIG. 1 of the drawings.

The sleeve 20 is illustrated as being in the form of an annular member 21 having one end 22 and an other end 23.

A bore referred to generally at 24 extends from the other end 23 of the sleeve 20 with the innermost portion or end 25 thereof being threaded as illustrated in FIG. 1 of the drawings. The threaded portion 25 is of suitable extent to accommodate the threads 8 on the one end of the body 7 to enable the sleeve 20 and the body 7 to be threadedly engaged as illustrated in FIG. 1 of the drawings. The annular shoulder 11 on the body 7 is provided with the end 16 which abuts the annular shoulder or ledge 25*a* formed in the longitudinally extending bore 24. It will be noted that the portion of the bore 24 represented by the numeral 26 in which the threaded portion 25 is provided is illustrated as being of smaller internal diameter than the portion of the bore 28 which extends from the annular shoulder 25*a* to the other end 23 of the body 7.

The bore portion 28 is provided with a plurality of circumferentially spaced longitudinally extending slots 29 which extend from a position adjacent but spaced from the annular shoulder 25*a* to the other end 23 of the body 7 to thereby form a plurality of circumferentially extending flexible portions 30 extending circumferentially between each of the longitudinally extending slots 29.

Each of the flexible portions 30 is provided with a circumferentially extending enlargement referred to generally at 40 on the end thereof for a purpose as will be described in greater detail hereinafter.

The enlargements 40 include a downwardly and inwardly extending sloping surface 31 which extends circumferentially and terminates at the edge of the circumferentially extending surface 32 adjacent the outer or the upper end of the sloping surface 31. An inwardly sloping surface 33 of relatively small extent in relation to the extent of the sloping surface 31 is provided and forms part of the intermediate circumferentially extending surface 32 and terminates at its juncture with the radially inwardly extending surface 34 which forms the annular ledge 35.

Figure 2:
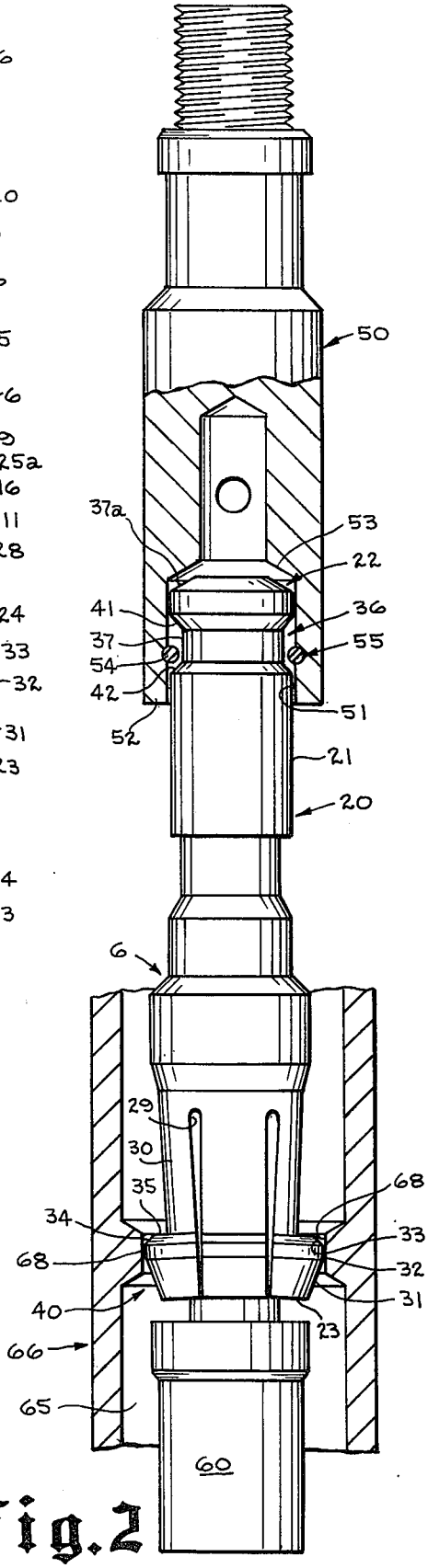
FIG. 2 is an elevational view of the latch illustrating it engaged with the lower end of a running tool, a portion of which is shown in section and illustrating the flexing of the latch to enable the member secured therewith to be moved into and releasably secured in the receiving section of a side pocket mandrel.

The end referred to at 22 of the sleeve 20 is provided with a configuration referred to generally at 36 for engagement with a running tool the lower portion of which is referred to generally at 50 in FIG. 2 of the drawings. The configuration 36 is illustrated as including an annular recess having a bottom surface 37 which terminates in the spaced end surfaces 41 and 42 extending generally radially outwardly therefrom as shown. The lower end 50 of the running tool, includes a socket 51 at the lowermost end 52 of the lower end portion of the running tool. Suitable means as illustrated generally at 55 are provided for releasably engaging the running tool, the lower end 50 which is illustrated in FIGS. 2 and 3 of the drawings, with the latch 6, such means including shear means as shown as being in the form of shear pins 54 which extend transversely of the bore 51 and are of a suitable size so that when positioned in openings provided on each side of the bore 51 as shown in FIG. 2 of the drawings they will project into the recess 37 formed adjacent the one end of the sleeve 20 to releasably lock the running tool and the latch 6 together.

The inner end 53 of the bore is of the same general configuration as the outermost end 37*a* of the sleeve 20 so that longitudinal blows may be transmitted through the string on which the running tool 50 is supported to aid in positioning the latch 6 and a member such as a valve or the like represented at 60 in FIG. 2 in the receiving section 65 of a side pocket mandrel referred to generally at 66. The receiving section 65 of the side pocket mandrel 66 includes an annular enlargement 68 to form a restriction through which the enlargements 40 formed on each of the flexible portions 30 must be forced so as to position the member 60 within the receiving section 65.

It can be appreciated that the member 60 is adapted to be secured to the latch 6 by threadedly engaging in the socket 13 prior to lowering it into the well bore. The running tool is connected to the latch 6 by engaging its lower end 50 therewith as shown in FIG. 2 and described hereinabove prior to lowering into the well. Lower end 50, latch 6 and member 60 are positioned relative to the receiving section 65 of the side pocket mandrel for releasably securing the member 60 in position therein. The positioning of the member 60 and latch 6 along with the running tool relative to the receiving section 65 is well known in the art and no detailed description is believed necessary to those skilled in such art. Also, the construction and function of the running tool is well known in the art, and therefore no detailed description is believed necessary.

Figure 3:
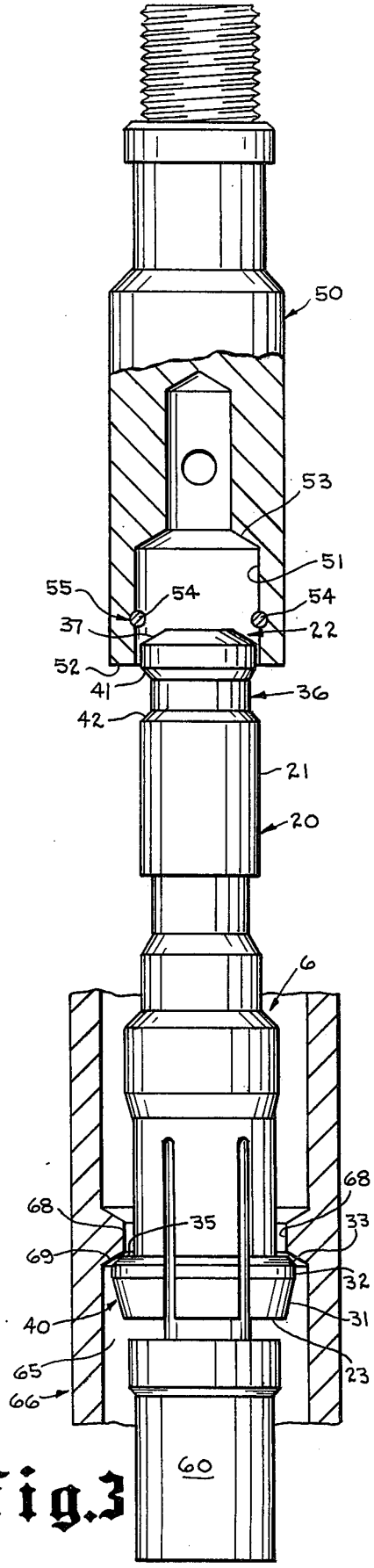
FIG. 3 is a view somewhat similar to FIG. 2 but illustrates the latch and members secured therewith in latched relationship in the receiving section of the side pocket mandrel and the running tool in released relation relative to the latch.

Longitudinal blows are transmitted through the well string upon which the running tool 50, latch 6 and member 60 are lowered into a well bore, so as to collapse the flexible portions 30 inwardly to enable the enlargements 40 on sleeve 20 to pass beyond the enlargement 68 in mandrel receiving section 65 to assume the position shown in FIG. 3 of the drawings. When the member 60, such as a valve or the like has been positioned as shown in FIG. 3, so that the annular ledge 35 is immediately beneath the annular enlargement 68, it is then desirable to disengage the running tool 50 from the sleeve 20 and this can be accomplished by applying a downward jar on the well string in which the running tool is positioned. This shears the shear pin 54 and releases the lower end 50 of the running tool from the end 22 of the sleeve 20 so that the running tool may be retrieved from the well bore, leaving the latch and member attached therewith in position in the mandrel.

When it is desired to pull the valve from the side pocket mandrel, a tool with a grappling end thereon, the configuration of which is well known in the art is lowered on a well string and aligned with the end 22 so that the grappling end thereof may engage with the recess 37 adjacent the end 22 to enable the latch 6 and member 60 to be removed from the receiving section 65. Such release is effected by applying an upward strain or a plurality of upward jars to the well string so that the sloping surface 35 engages with the nether surface 69 of the enlargement 68 to again flex the portions 30 inwardly to enable the latch 6 to become disengaged from the receiving section.

It can be appreciated that since the present invention enables the longitudinal portions 30 to flex, wear of the annular enlargement 40 on each of the flexible portions 30 is reduced. Also, since the body 7 and the sleeve 20 are threadedly secured together, it is not necessary to replace any shear pins therebetween as may be necessary with some forms of prior art devices.

The foregoing disclosure and description of the invention are illustrative and explanatory thereof, and various changes in the size, shape, and materials as well as in the details of the illustrated construction may be made without departing from the spirit of the invention.

What is claimed is:

1. A latch for use with a running tool to position a member in a receiving section of a side pocket mandrel including:

a. a body having one end thereof threaded externally;

b. a threaded socket formed on the outer end of said body for engaging with the member to be positioned in the mandrel side pocket;

c. a sleeve having one end thereof configured for engagement with a running tool;

d. the other end of said sleeve having a bore therein, the innermost end of which is threaded whereby said sleeve may be threadedly engaged with said one end of said body;

e. said bore adjacent said other end of said sleeve having a plurality of longitudinally extending; circumferentially spaced slots to form a plurality of flexible portions on said other end of said sleeve; and f. each of said flexible portions having a circumferentially extending enlargement adjacent the end thereof.

2. The invention of claim 1 wherein said enlargements each include:

a. a downwardly and inwardly extending sloping surface;

b. an intermediate circumferentially extending surface joining said sloping surface at the upper end thereof; and c. a radially inward extending surface extending from said intermediate surface to form an annular ledge.

3. The invention of claim 1 wherein said configured one end of said sleeve includes a recessed portion having spaced shoulder means formed at each end thereof.

4. An arrangement for positioning a member in a receiving section of a side pocket mandrel in a well tubing including:

a. latch means for releasably securing the member in the side pocket mandrel receiving section, said latch means including:

1. a body having one end thereof threaded externally;
2. a threaded socket formed on the other end of said body for engaging with the member to be positioned in the mandrel side pocket;
3. a sleeve having one end thereof configured for engagement with a running tool;
4. the other end of said sleeve having a bore therein, the innermost end of which is threaded whereby said sleeve may be threadedly engaged with said one end of said body;
5. said bore adjacent said other end of said sleeve having a plurality of longitudinally extending circumferentially spaced slots to form a plurality of flexible portions on said other end of said sleeve; and
6. each of said flexible portions having a circumferentially extending enlargement adjacent the end thereof, b. a running tool to position said latch means and member in the mandrel side pocket receiving section;

c. means to releasably secure said latch means and running tool together to enable said running tool to secure the member in the side pocket mandrel receiving section; said means including:

1. a recessed portion on said configured one end of said sleeve having shoulder means formed at each end thereof;
2. shear pin means engaging said running tool and fitting within the recessed portion;
3. socket means in said running tool in which said configured one end of said sleeve is received for enabling downward longitudinal blows to be delivered to said latch means and member supported thereby to releasably secure them in said side pocket mandrel receiving section.

5. The invention of claim 4 wherein said enlargements each include:

a. a downwardly and inwardly extending sloping surface;

b. an intermediate circumferentially extending surface joining said sloping surface at the upper end thereof; and c. a radially inward extending surface extending from said intermediate surface to form an annular ledge.

* * * * *